US007565757B2

(12) United States Patent
Whitten et al.

(10) Patent No.: US 7,565,757 B2
(45) **Date of Patent: *Jul. 28, 2009**

(54) CUTTING ELEMENT SUPPORTED ON A CHAIN

(75) Inventors: Dean Whitten, Pella, IA (US); Dan Hawks, Pella, IA (US); Mark Cooper, Pella, IA (US)

(73) Assignee: Vermeer Manufacturing Co., Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/188,308

(22) Filed: Aug. 8, 2008

(65) Prior Publication Data

US 2009/0000155 A1 Jan. 1, 2009

Related U.S. Application Data

(60) Division of application No. 11/430,804, filed on May 9, 2006, now Pat. No. 7,409,785, and a division of application No. 10/962,909, filed on Oct. 12, 2004, now Pat. No. 7,055,270, and a continuation of application No. 10/444,178, filed on May 23, 2003, now Pat. No. 6,839,991.

(51) Int. Cl.
*E02F 3/14* (2006.01)
*E02F 9/28* (2006.01)

(52) U.S. Cl. ..... 37/465

(58) Field of Classification Search ..... 37/462–465, 37/190, 450–459, 386–388, 352–365, 392, 37/189, 208–210, 244, 326–328, 332; 172/765–770, 172/772, 772.5, 518, 540, 554, 550; 299/39.1–41.1; 404/90

See application file for complete search history.

(56) References Cited

U.S. PATENT DOCUMENTS

| | | | |
|---|---|---|---|
| 2,636,291 | A | 4/1953 | Reagle |
| 3,331,637 | A | 7/1967 | Krekeler |
| 3,846,922 | A | 11/1974 | Horton |
| 4,489,987 | A | 12/1984 | Towers |
| 4,650,254 | A | 3/1987 | Wechner |
| 4,697,850 | A | 10/1987 | Tuneblom |
| 4,755,001 | A | 7/1988 | Gilbert |
| 4,915,455 | A | 4/1990 | O'Neill |
| 5,810,449 | A | 9/1998 | Grathoff |
| 6,276,758 | B1 | 8/2001 | Hoffmann |

(Continued)

FOREIGN PATENT DOCUMENTS

| | | |
|---|---|---|
| EP | 744495 | 11/1996 |

(Continued)

OTHER PUBLICATIONS

Catalog by Kennametal—40 pages, showing numerous cutting tools—dated 2002.

*Primary Examiner*—Christopher J. Novosad
(74) *Attorney, Agent, or Firm*—Sturm & Fix LLP

(57) ABSTRACT

In a chain excavator including an excavation chain with links routed around a drive sprocket and an end idler with a base plate mounted to a link for supporting excavation implements, a stabilizing element extends rearwardly from directly behind the excavation implement in order to contact and be supported by its trailing base plate.

4 Claims, 7 Drawing Sheets

U.S. PATENT DOCUMENTS

| | | | | |
|---|---|---|---|---|
| 6,438,874 | B1 | 8/2002 | LaBounty | |
| 6,547,336 | B2 | 4/2003 | Hoffmann | |
| 6,725,579 | B2 | 4/2004 | Unzicker | |
| 6,779,850 | B1 | 8/2004 | Schibeci | |
| 6,839,991 | B2 * | 1/2005 | Whitten et al. | 37/465 |
| 2005/0001084 | A1 | 1/2005 | Pizzuto | |

FOREIGN PATENT DOCUMENTS

| | | |
|---|---|---|
| EP | 1214979 | 6/2002 |
| WO | WO 00/70149 | 11/2000 |
| WO | WO 03/031069 | 4/2003 |

* cited by examiner

CUTTING ELEMENT SUPPORTED ON A CHAIN

CROSS REFERENCE TO RELATED APPLICATIONS

This application is a Divisional of U.S. patent application Ser. No. 11/430,804, filed May 9, 2006, entitled CUTTING ELEMENT SUPPORTED ON A CHAIN, now U.S. Pat. No. 7,409,785 issued Aug. 12, 2008, which is a Divisional of U.S. Ser. No. 10/962,909, filed Oct. 12, 2004, entitled CUTTING ELEMENT SUPPORTED ON A DRUM, now U.S. Pat. No. 7,055,270, issued Jun. 6, 2006, which is a continuation of U.S. Ser. No. 10/444,178, filed May 23, 2003, entitled CYLINDRICAL CUTTING ELEMENT SUPPORTED ON A CHAIN, now U.S. Pat. No. 6,839,991, issued Jan. 11, 2005, and are incorporated by reference herein in their entirety.

STATEMENT REGARDING FEDERALLY SPONSORED RESEARCH OR DEVELOPMENT

Not Applicable

FIELD OF THE INVENTION

The present invention relates to a mounting arrangement for mounting a cylindrical cutting element to a chain to provide support necessary for cutting difficult materials such as rock formations, and road surfaces.

BACKGROUND OF THE INVENTION

Cylindrical cutting elements are often mounted to a variety of driven elements to perform excavations of various difficult type of ground, including compacted sands, clay, gravel and rock. The driven elements include drums and chains. FIGS. 1-4 illustrate a prior art trencher 100 with a typical roller chain assembly 10. FIG. 1 illustrates the trencher 100 with a boom 102 in a raised position, and a lowered position. In the lowered position, the boom 102 forces the roller chain assembly 10 into engagement with the ground. The chain is powered by a drive sprocket, not shown, such that end idler 104 will rotate clockwise, and the bottom strand of the roller chain assembly 10 will move from right to left. When in engagement with the ground the chain assembly 10 will excavate and transport cuttings to a discharge conveyor 106, thus forming a trench as the trencher 100 moves from right to left. FIG. 2 illustrates a typical roller chain assembly 10 comprising attachment links 12, side links 14, and rollers 16. The chain assembly 10 further comprises base plates 18, conical cutters 20, tool holders 22 and back bend bars 24, as illustrated in FIGS. 3 and 4. FIG. 3 illustrates a double chain assembly where the base plates are each attached to 2 chains. The conical cutters 20 are positioned on the base plates at an angle such that they contact the ground at the required orientation. The chain assembly 10 will move from left to right as illustrated in FIG. 4, with the conical cutter 20 contacting the ground. This contact will generate an excavation force F1 on the tip of the conical cutter 20A. Conical cutter 20A is mounted to baseplate 18A which is mounted to attachment links 12A. The force F1 will generate a moment, substantially around axis 13. The chain assembly 10 will flex until backbend bars 24A contact side links 14A. In this manner the back bend bars 24 stiffen the chain assembly 10.

When utilized in extreme conditions this type of drive and mounting arrangement is has been found to be insufficient.

There are times that the tool holders 22 are not sufficiently attached to the base plates and that the overall chain assembly includes sufficient flexibility to induce unwanted vibrations.

An improved mounting arrangement is needed for application of this type of excavation assembly in extreme conditions.

BRIEF SUMMARY OF THE INVENTION

According to the present invention there is provided an improved mounting arrangement for a conical cutter to a chain assembly

DETAILED DESCRIPTION OF THE INVENTION

Figure 1:
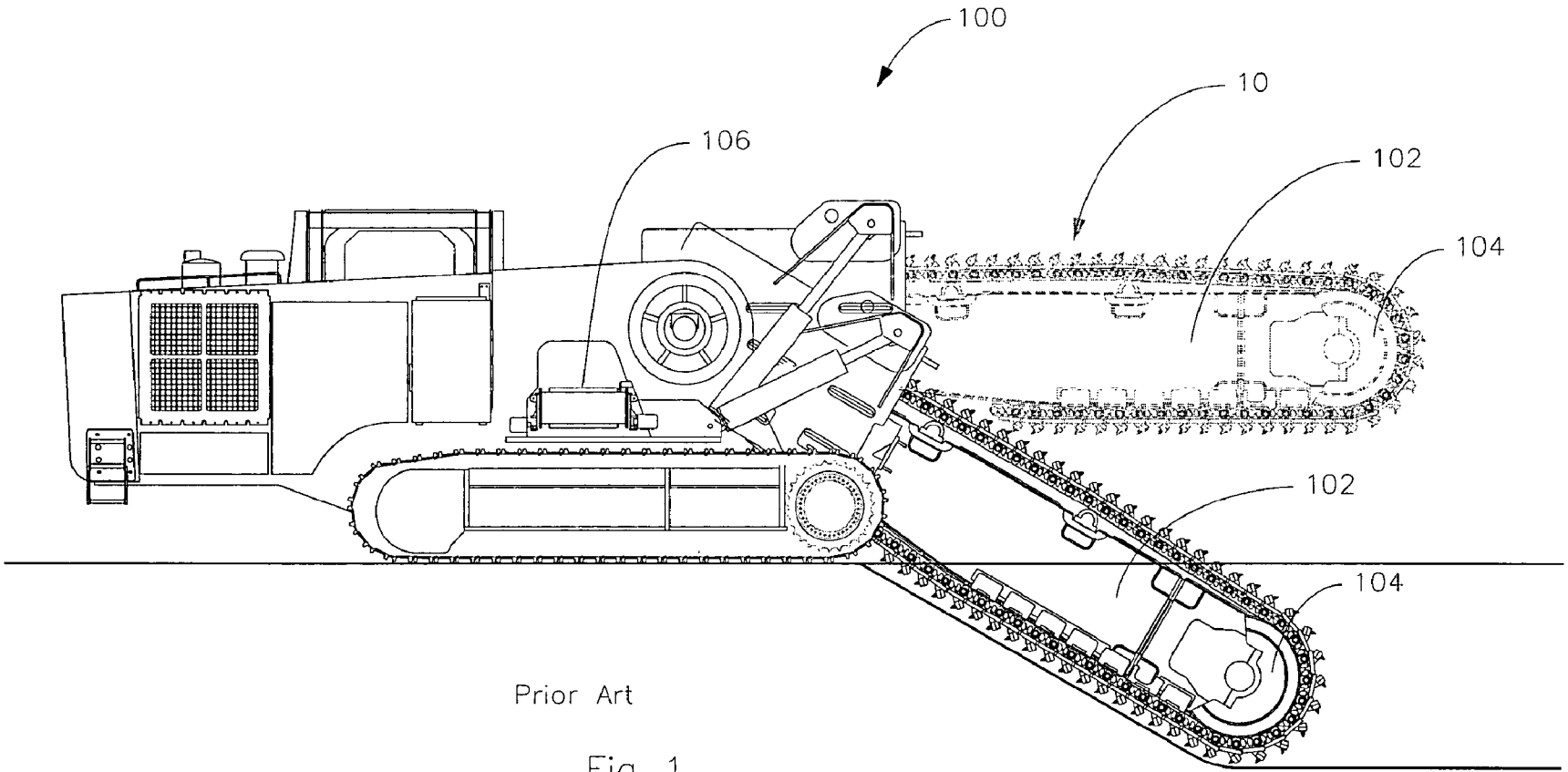
Prior Art Fig 1
FIG. 1 is a side plan view of a prior art trencher with a boom in 2 positions with a prior art chain assembly.
Figure 2:
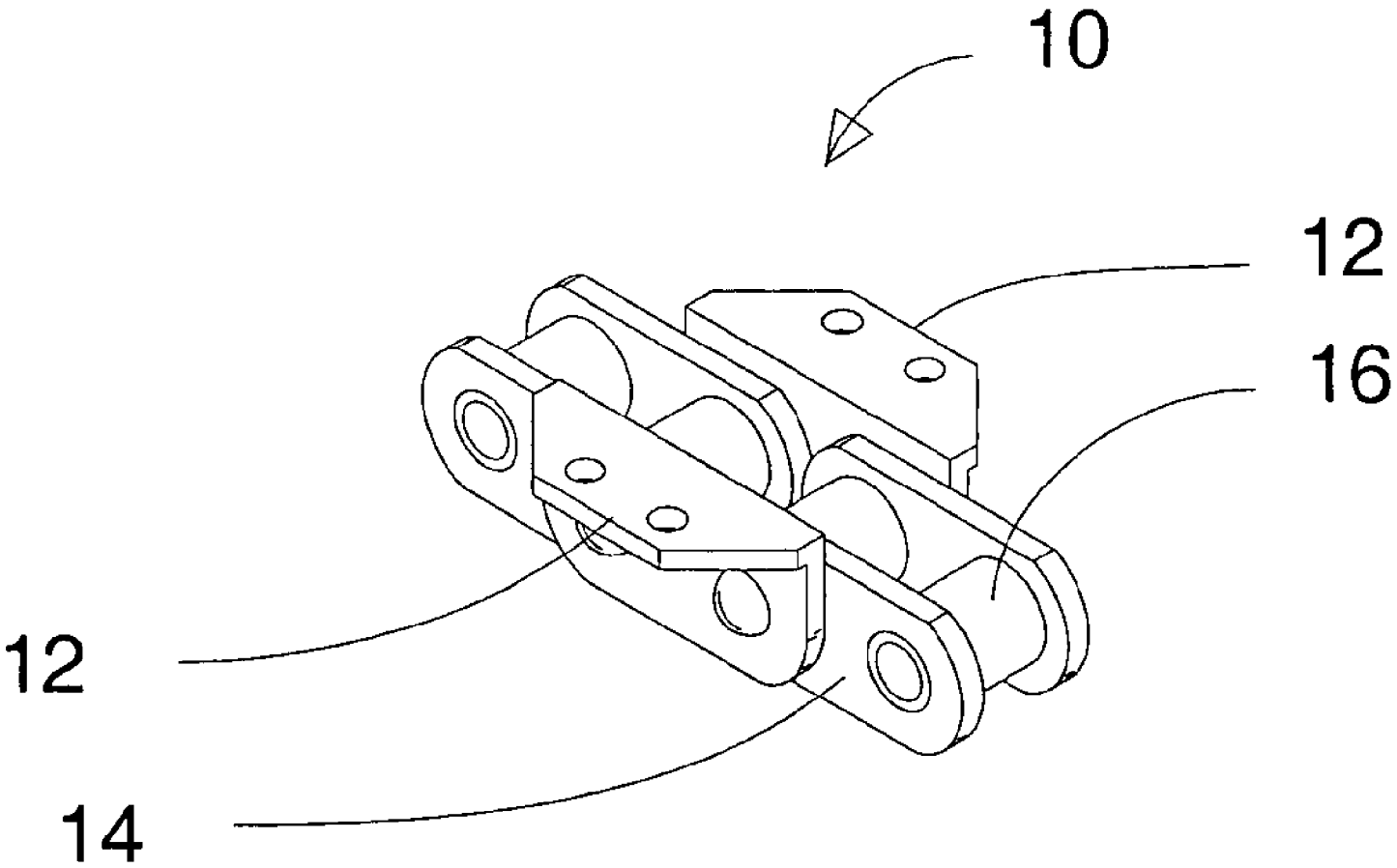
(Prior Art) Fig. 2
FIG. 2 is an isometric view of a prior art roller chain.
Figure 3:
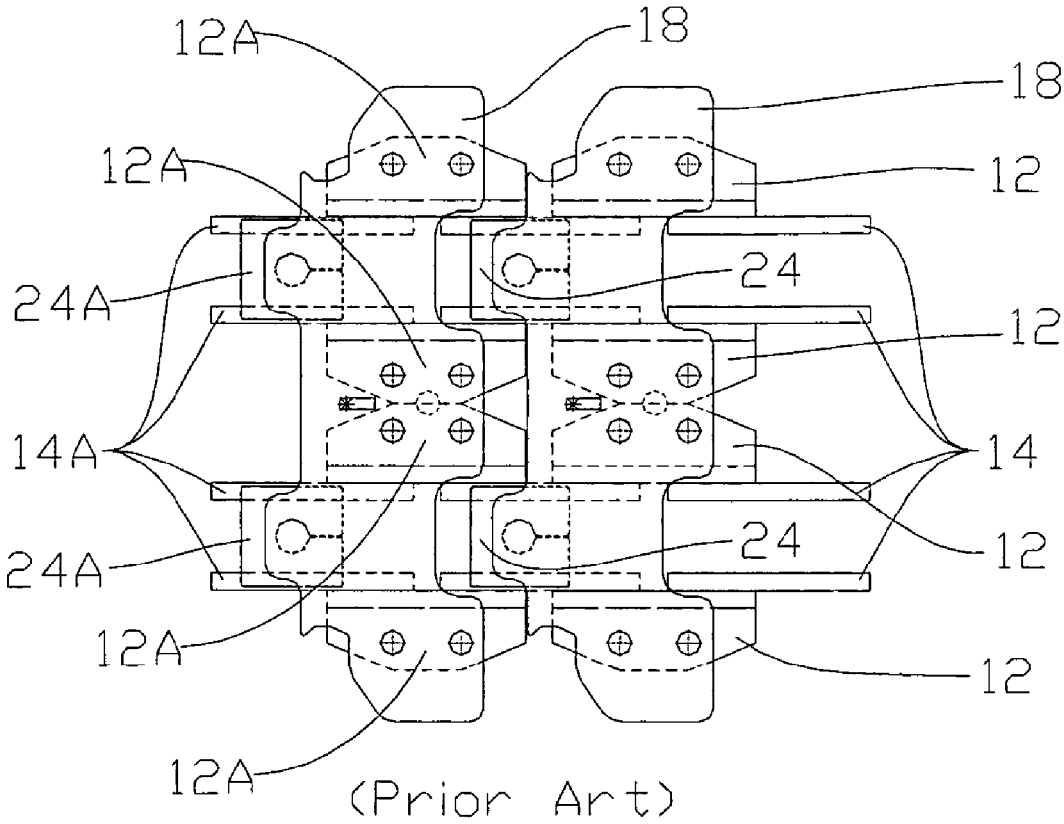
(Prior Art) Fig. 3
FIG. 3 is a top view of a prior art chain assembly.
Figure 4:
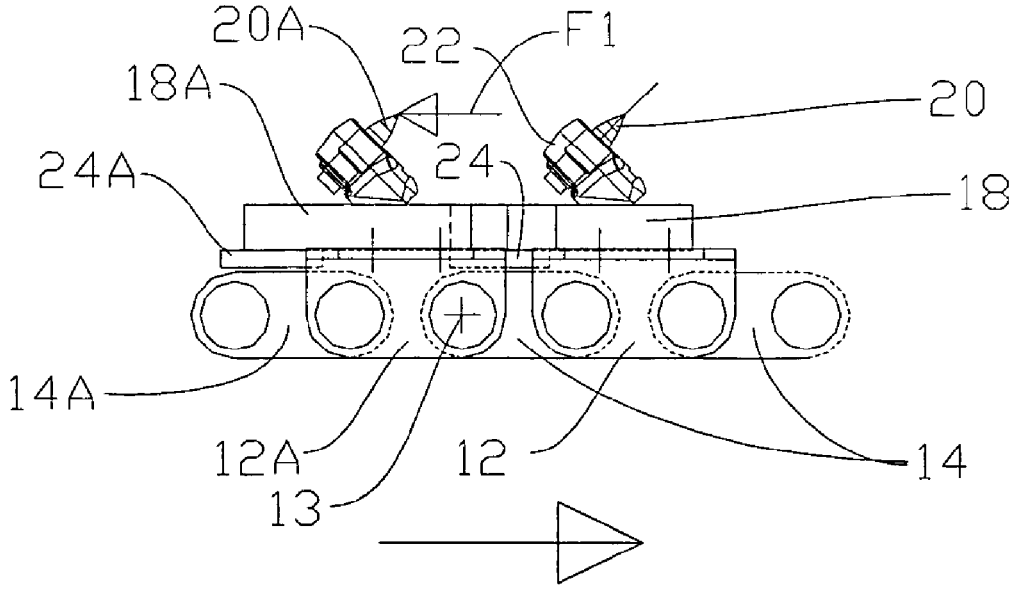
(Prior Art) Fig. 4
FIG. 4 is a side view of a prior art chain assembly.

Referring now to the drawings, like reference numerals designate identical or corresponding parts throughout the several views. The included drawings reflect the current preferred embodiment. There are many additional embodiments that may utilize the present invention. The drawings are not meant to include all such possible embodiments.

Figure 5:
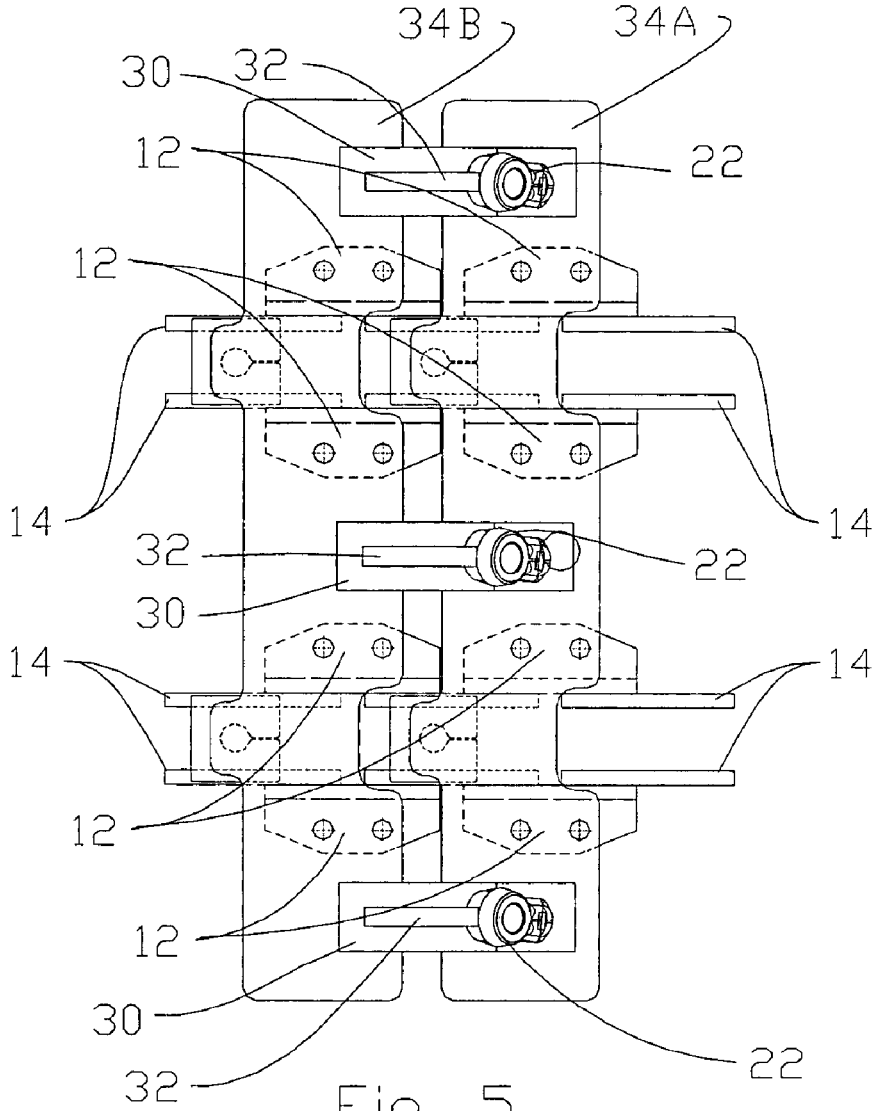
FIG. 5 is a top view of the chain assembly of the present invention.
Figure 6:
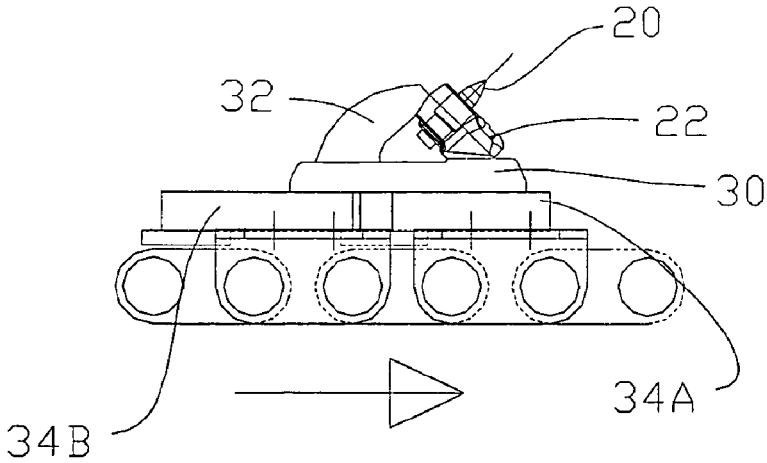
FIG. 6 is a side view of the chain assembly of the present invention.

FIGS. 5 and 6 illustrate the tool holder 22 supported on a bottom plate 30 and a support gusset 32. Support gusset 32 is attached on a first end to bottom plate 30 and on its opposite end to the tool holder 22. Bottom plate 30 is secured to the base plate 34A and also supported by contact with base plate 34B, when in the configuration illustrated in FIG. 6. In this manner the resulting chain assembly provides improved stiffness, and a more robust mounting arrangement for tool holder 22. The bottom plate 30 and the support gusset 32 can be made in one piece or several pieces connected together. Even the tool holder 22 for holding tooth 20 can be make in one piece with the bottom plate 30 and the support gusset 32 if desired. The supporting gusset 32 extends from directly behind the cutter or tooth 20, and it contacts the base plate 32 and not the chain link 14 when forces are applied to the tooth 20 while in operation of the chain trencher.

Figure 7:
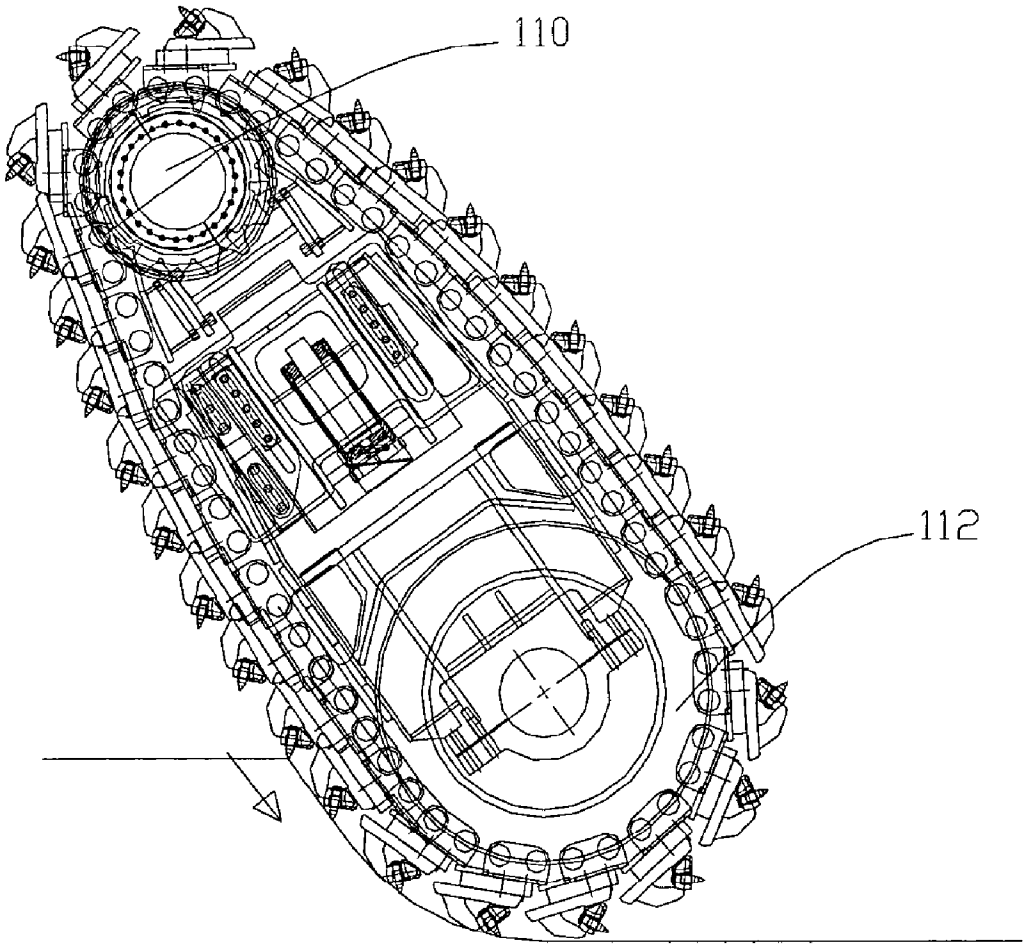
FIG. 7 is a side view of a boom assembly utilizing a chain assembly of the present invention.

The resulting chain is illustrated in an assembly between a drive sprocket 110 and an end idler 112 in FIG. 7. As the chain assembly travels around the drive sprocket 110 and end idler 112 the bottom plate 30 will separate from the trailing base plate such that the extra rigidity resulting from the contact between the bottom plate 30 and its trailing base plate 34. Gusset 32, however, provides additional support of the tool holder 22 such that, even in the position where the chain is travelling over the end idler 112, the connection of the tool holder to the base plate 34 is enhanced.

Gusset 32 sweeps back in a configuration such that it is always positioned at an effective radius that is less than the effective radius swept out by the point of the conical cutter 20.

Figure 8:
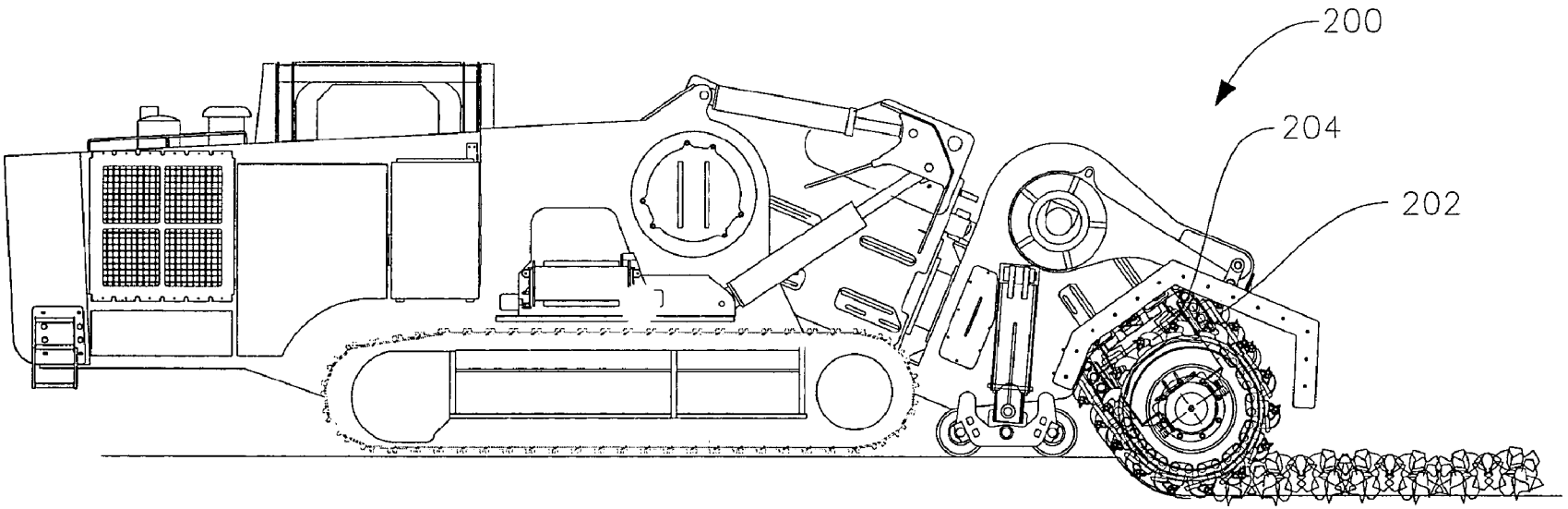
FIG. 8 is a side plan view of a trencher including a chain boom and excavating drums.
Figure 9:
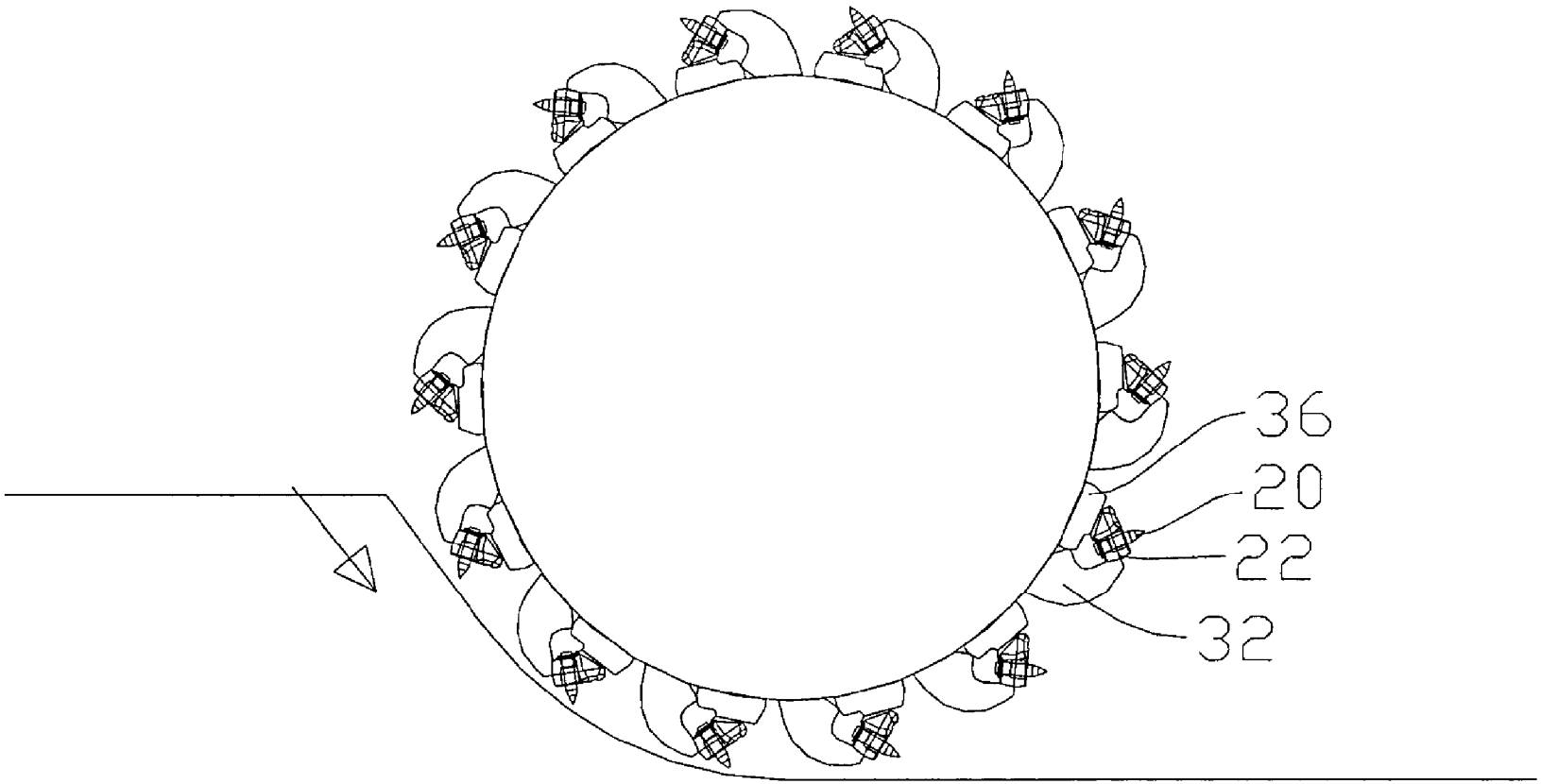
FIG. 9 is a side view of an excavating drum configured according to the present invention.

FIG. 8 illustrates a trencher 200 with a boom assembly including a center excavating chain 202 and 2 excavating drums 204 as described in pending U.S. patent application Ser. No. 10/227,838 filed Aug. 27, 2002, filed by assignee entitled excavation apparatus, which application is incorporated herein by reference. The excavating chain 202 of trencher 200 is configured to include the gusset 32 and bottom plate 30 supporting tool holder 22. The tool holders 22 that are attached to the excavating drums are similarly supported by gussets 34, and bottom plate 36 as illustrated in FIG. 9.

Obviously many modifications and variations of the present invention are possible in light of the above teachings, including variations in the shape of the knife mount pin and cooperating apertures in the knife adapter. It is known to use various configurations of these components, other than the herein specified cylindrical shapes. These would include conical sections, and could include pins with various cross-sections such as square or hexagonal. It is therefore to be understood that, within the scope of the appended claims, the invention may be practiced otherwise than as specifically described.

We claim:

1. In a chain excavator including an excavation chain with a plurality of links connected together, each of the links having an inner portion including rollers adapted to contact teeth on a drive sprocket and an outer portion, the excavation chain being trained around the drive sprocket and an end idler, a first base plate having an inner part and an outer part, said first base plate being mounted on an outer portion of a first one of the links and a tooth support being operatively attached to an outer portion of the first base plate for supporting at least one excavation tooth, a second base plate operatively connected to an outer portion of a second one of the links following the first link, the improvement comprising:

(a) a gusset operatively attached to the outer part of the first base plate and extending radially outwardly from the base plate as the chain wraps around the end idler, said gusset being disposed directly behind at least a portion of the tooth support and operatively attached to the at least a portion of the tooth support; and (b) said gusset extending radially outwardly with respect to the second base plate as the chain wraps around the end idler, whereby forces on the tooth in use of the excavation chain are transmitted through the gusset to the second base plate.

2. The chain excavator of claim 1 wherein the tooth support has an opening disposed there through and the tooth extends completely through the opening.

3. The chain excavator of claim 2 wherein the opening in tooth support has an outer portion and an inner portion, a space between the gusset and the tooth support being provided for accessing an inner end of the tooth.

4. The chain excavator of claim 1 wherein the gusset is narrower than the at least a portion of the tooth support to protect the gusset from wear.

* * * * *